US008171998B1

(12) United States Patent
Darnell et al.

(10) Patent No.: US 8,171,998 B1
(45) Date of Patent: May 8, 2012

(54) SYSTEM FOR CONTROLLING HYDROCARBON BEARING ZONES USING A SELECTIVELY OPENABLE AND CLOSABLE DOWNHOLE TOOL

(75) Inventors: William John Darnell, Houston, TX (US); Charles David Wintill, Houston, TX (US); Rodney Wayne Long, Cypress, TX (US); Todd Ulrich Chretien, Sr., Houston, TX (US); Tracy Dean Blanton, Houston, TX (US); William Ryle Darnell, St. Martinville, LA (US)

(73) Assignee: Petroquip Energy Services, LLP, Houston, TX (US)

( * ) Notice: Subject to any disclaimer, the term of this patent is extended or adjusted under 35 U.S.C. 154(b) by 0 days.

(21) Appl. No.: 13/006,946

(22) Filed: Jan. 14, 2011

(51) Int. Cl.
*E21B 43/00* (2006.01)
*E21B 34/10* (2006.01)

(52) U.S. Cl. ..... 166/369; 166/320; 166/332.1; 166/375; 166/386

(58) Field of Classification Search ..... 166/369, 166/375, 386, 320, 332.1, 240
See application file for complete search history.

(56) References Cited

U.S. PATENT DOCUMENTS

| | | | | |
|---|---|---|---|---|
| 5,664,629 | A | 9/1997 | Maitland | |
| 6,189,619 | B1 | 2/2001 | Wyatt et al. | |
| 6,237,683 | B1 | 5/2001 | Pringle et al. | |
| 6,302,203 | B1 | 10/2001 | Rayssiquier et al. | |
| 6,631,767 | B2 * | 10/2003 | Pringle et al. | 166/320 |
| 6,668,935 | B1 * | 12/2003 | McLoughlin et al. | 166/375 |
| 6,782,948 | B2 | 8/2004 | Echols et al. | |
| 6,892,816 | B2 * | 5/2005 | Pringle et al. | 166/320 |
| 6,966,380 | B2 * | 11/2005 | McLoughlin et al. | 166/320 |
| 6,973,974 | B2 * | 12/2005 | McLoughlin et al. | 166/386 |
| 6,983,796 | B2 | 1/2006 | Bayne et al. | |
| 7,013,980 | B2 * | 3/2006 | Purkis et al. | 166/386 |
| 7,182,139 | B2 * | 2/2007 | Rayssiguier et al. | 166/374 |
| 7,252,437 | B2 | 8/2007 | Ringgenberg | |
| 7,377,327 | B2 * | 5/2008 | Jackson | 166/386 |
| 7,387,164 | B2 * | 6/2008 | Pringle et al. | 166/305.1 |
| 7,392,839 | B1 | 7/2008 | Wintill et al. | |
| 7,422,065 | B1 | 9/2008 | Wintill et al. | |
| 7,464,759 | B1 | 12/2008 | Wintill et al. | |
| 7,584,800 | B2 * | 9/2009 | Heath et al. | 166/386 |
| 7,730,953 | B2 * | 6/2010 | Casciaro | 166/321 |
| 7,870,908 | B2 * | 1/2011 | Mandrou | 166/386 |
| 2001/0040030 | A1 | 11/2001 | Lerche et al. | |
| 2001/0045290 | A1 * | 11/2001 | Pringle et al. | 166/386 |
| 2002/0053438 | A1 * | 5/2002 | Williamson, Jr. | 166/373 |
| 2002/0084075 | A1 | 7/2002 | Johansen | |
| 2002/0134551 | A1 * | 9/2002 | Pringle et al. | 166/305.1 |
| 2004/0159445 | A1 | 8/2004 | Hazel et al. | |
| 2005/0034875 | A1 * | 2/2005 | McLoughlin et al. | 166/386 |
| 2005/0039914 | A1 * | 2/2005 | Purkis et al. | 166/250.15 |
| 2007/0012458 | A1 * | 1/2007 | Jackson | 166/386 |
| 2007/0102163 | A1 * | 5/2007 | Heath et al. | 166/386 |

(Continued)

*Primary Examiner* — Jennifer H Gay
(74) *Attorney, Agent, or Firm* — Buskop Law Group, PC; Wendy Buskop

(57) ABSTRACT

One or more embodiments of a selectively openable and closable downhole tool. The wherein, the downhole tool can include an outer tubular member having an annulus port formed therethrough. The downhole tool can also include an inner tubular member. The inner tubular member can include an inner port. The inner port and annulus port can be selectively aligned to form a flow path therethrough by moving the inner tubular member relative to the outer tubular member. The downhole tool can also include a logic drum configured to selectively move the inner tubular member. The downhole tool can also include a piston assembly configured to move the logic drum.

2 Claims, 9 Drawing Sheets

U.S. PATENT DOCUMENTS

2009/0050335 A1* 2/2009 Mandrou ..... 166/386
2009/0159290 A1* 6/2009 Lauderdale ..... 166/319
2009/0218102 A1* 9/2009 Casciaro ..... 166/321
2010/0206579 A1* 8/2010 Guven et al. ..... 166/373

* cited by examiner

SYSTEM FOR CONTROLLING HYDROCARBON BEARING ZONES USING A SELECTIVELY OPENABLE AND CLOSABLE DOWNHOLE TOOL

FIELD

The present embodiments generally relate to a downhole tool.

BACKGROUND

A need exists for a downhole tool that can be selectively opened and closed in a well.

A need exists for a downhole tool that can be shifted from a closed position to an open position, or alternatively from an open position to a closed position, without losing integrity.

The present embodiments meet these needs.

BRIEF DESCRIPTION OF THE DRAWINGS

The detailed description will be better understood in conjunction with the accompanying drawings as follows.

Figure 1:
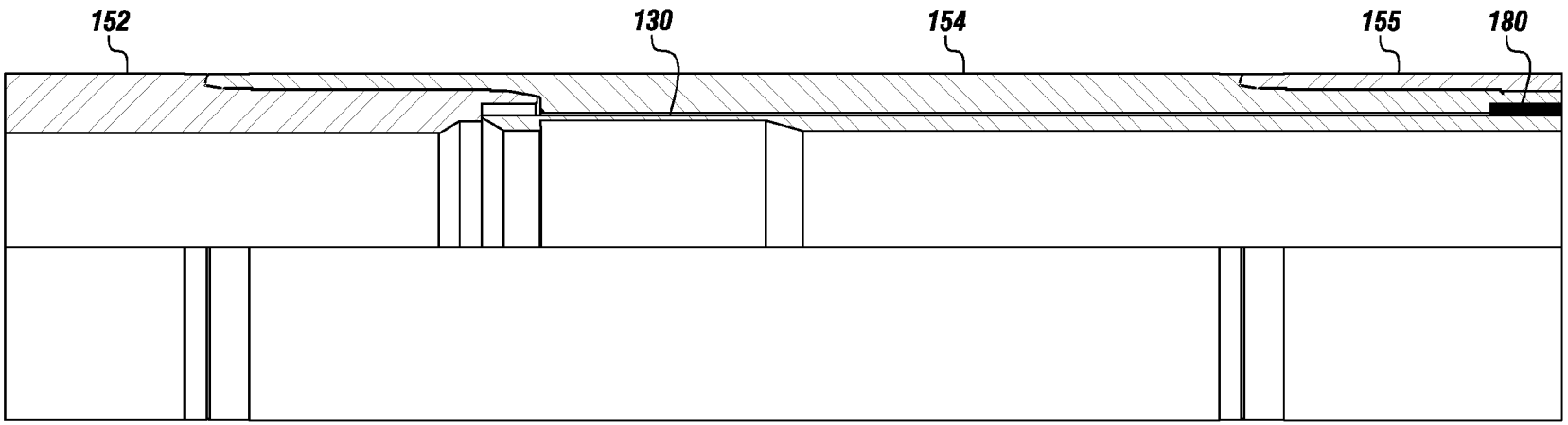
FIG. 1 depicts a cross sectional view of a top portion of a downhole tool assembly having a top sub operatively engaged with a downhole tool according to one or more embodiments.

The present embodiments are detailed below with reference to the listed Figures.

DETAILED DESCRIPTION OF THE EMBODIMENTS

Before explaining the present apparatus and system in detail, it is to be understood that the apparatus and system are not limited to the particular embodiments and that they can be practiced or carried out in various ways.

The present embodiments generally relate to a downhole tool.

In one or more embodiments, the downhole tool can include an outer tubular member. The outer tubular member can have an annulus port formed therethrough. The annulus port can be a hole, nozzle, the like, or combinations thereof. The outer tubular member can be a pipe, mandrel, or the like.

The outer tubular member can be disposed at least partially about an inner tubular member. The inner tubular member can be a pipe, mandrel, or the like. The inner tubular member can include an inner port formed therethrough. The inner port can be a hole, nozzle, the like, or combinations thereof.

The inner tubular member can move relative to the outer tubular member. For example, the inner tubular member can be relative to the outer tubular member, the inner port and annulus port can be selectively aligned to form a flow path therethrough and selectively misaligned to at least partially prevent fluid communication from a wellbore and an inner bore of the inner tubular member.

In one or more embodiments, the inner tubular member can be a sleeve with an inner port formed therethrough. The inner tubular member can be disposed within the outer tubular member, such that the inner tubular member moves relative to the outer tubular member.

The downhole tool can include a logic drum. The logic drum can be configured to move the inner tubular member. The logic drum can be operatively disposed adjacent the inner tubular member. The logic drum can be any logic drum. For example, the logic drum can be similar to one or more logic drums described herein or one or more logic drums that are commercially available.

A piston assembly configured to move the logic drum can be operatively disposed adjacent the logic drum. The piston assembly can include a first port in communication with a first control line and a second port in communication with a second control line. The first port and second port can each be a hole, a nozzle, the like, or combinations thereof.

The control lines can be any fluid communication line, such as a hydraulic line, pneumatic line, inert gas line, the like, or combinations thereof. The first control line and the second control line can be configured to communicate with additional downhole equipment through a continuous flow path.

In one or more embodiments, the piston assembly can include one or more piston chambers in communication with the first port and the second port. The piston chamber can be sealed off from other portions of the downhole tool.

The piston chamber can have a piston operatively disposed therein. For example, the piston can be disposed between the first port and the second port.

The piston can be any device or apparatus that is configured to move within the piston chamber. For example, the piston can be a cylindrical rod or other shaped rod. The piston can be made from any material.

A force transmitting device can be connected to the piston. The force transmitting device can be any device configured to slide within one or more grooves formed into the logic drum and transfer force from the piston to the logic drum.

In one or more embodiments, the downhole tool can include one or more logic drums. For example, the downhole tool can have two logic drums.

In addition, in one or more embodiments, the downhole tool can include one or more piston assemblies. One or more of the piston assemblies can include one or more pistons, one or more pistons chambers, and one or more ports.

For example, the piston assembly can include a first piston chamber having a first set of pistons located therein, and a second piston chamber having a second piston set located therein. Each piston set can include one or more pistons. The first piston chamber and the second piston chamber can have a first port and a second port. Each first port can be in communication with one of the control lines, and each second port can be in communication with the other control line.

In addition, the first piston set can be operatively connected to one or more first force transmitting devices, and the second piston set can be connected to one or more second force transmitting devices. The first force transmitting device can be configured to move within grooves of a first logic drum and transfer force thereto, and the second force transmitting device can be configured to move within grooves of a second logic drum and transmit force thereto.

In one or more embodiments, the downhole tool can include a top sub operatively engaged with one or more piston assemblies. For example, a connector, cross over pin, or both can be used to operatively engage the top sub with one or more piston assemblies.

The connector can be configured to provide space within the system, downhole tool, or combinations thereof.

The piston assembly can operatively engage the outer tubular member. For example, a connector, cross over pin, or both can engage the outer tubular member.

The outer tubular member can operatively engage a bottom sub. For example, a connector, cross over pin, or both can be used to operatively engage the outer tubular member with the bottom sub.

The downhole tool can be configured to connect to a tubing string. Accordingly, one or more downhole tools can be connected by tubing string to form a system for controlling multiple hydrocarbon bearing zones in a wellbore.

The system can include two control lines for bidirectional control of a plurality of the downhole tools. The two control lines can be in fluid communication with each of the downhole tools through a continuous flow path. The downhole tools can be substantially similar to those described herein.

For example, the downhole tools can be connected to one another by tubing string, one of the downhole tools can be adjacent a first hydrocarbon bearing zone, and another of the downhole tools can be adjacent a second hydrocarbon bearing zone.

The tubing string can have one or more sealing devices for isolating the hydrocarbon bearing zones from one another. The sealing devices can be any device capable of at least partially sealing off an annulus formed between the system and the wellbore. Accordingly, the two control lines can be used to selectively produce, isolate, or combinations thereof the independent hydrocarbon bearing zones.

The logic drum of the downhole tool adjacent one of the hydrocarbon bearing zones, such as the first hydrocarbon bearing zone, can be out of phase or in phase with the logic drum of the downhole tool adjacent another of the hydrocarbon bearing zones, such as the second hydrocarbon bearing zone. If the logic drum of the downhole tool adjacent the first hydrocarbon bearing zone is in phase with the logic drum of the downhole tool adjacent the second hydrocarbon bearing zone, the hydrocarbon bearing zones can be produced at the same time. If the logic drum of the downhole tool adjacent the first hydrocarbon bearing zone is out of phase with the logic drum of the downhole tool adjacent the second hydrocarbon bearing zone, one of the zones can be isolated while the other zone is produced.

The downhole tool and systems described herein can also be used to perform a method for controlling at least two hydrocarbon bearing zones that are isolated from one another.

The method can include communicating two control lines with a downhole tool adjacent one of the hydrocarbon bearing zones, and with another downhole tool adjacent another hydrocarbon bearing zone. Each of the control lines can be in fluid communication with the downhole tools through two continuous flow paths.

The method can also include producing one of the hydrocarbon bearing zones by moving at least a portion of the adjacent downhole tool. Moving a portion of the downhole tool can include pressuring up one of the control lines. The method can also include isolating the other remaining hydrocarbon bearing zones with adjacent downhole tools.

The method can also include preventing production from the producing hydrocarbon bearing zone by pressuring up the other control line and moving at least a portion of the downhole tool adjacent the producing hydrocarbon bearing zone.

In one or more embodiments, the method can also include moving a portion of the downhole tools isolating the adjacent hydrocarbon bearing zones by pressuring up one of the control lines, allowing production from at least two of the hydrocarbon bearing zones.

FIG. 1 depicts a cross sectional view of a top portion of a downhole tool assembly having a top sub operatively engaged with a downhole tool according to one or more embodiments.

A top connector 154 can be configured to connect to a downhole tubular. For example, the top connector 154 can connect to a top sub 152, which can be made of carbon steel, or a nickel alloy, and can be made by PetroQuip Energy Services, LLP of Houston, Tex.

An inner tubular member 130 can at least partially move within the top sub 152, the top connector 154, or both.

A cross over pin 155 can connect the top connector 154.

A first seal assembly 180 can be disposed between the inner tubular member 130 and the top connector 154. The first seal assembly 180 can be any non-elastomeric material. The first seal assembly 180 can be one or more seals or seal assemblies described herein or one that is commercially available. For example, the first seal assembly 180 can be made from TEFLON™ brand polytetrafluoroethylene, available from DuPont of Wilmington, Del., and PEEK™ (polyester ester ketone), also made by Dupont. The first seal assembly 180 can also be made from a blend of a 95 percent PEEK and 5 percent VITON™ brand fluoropolymer elastomer, which is available from Dupont.

Figure 2A:
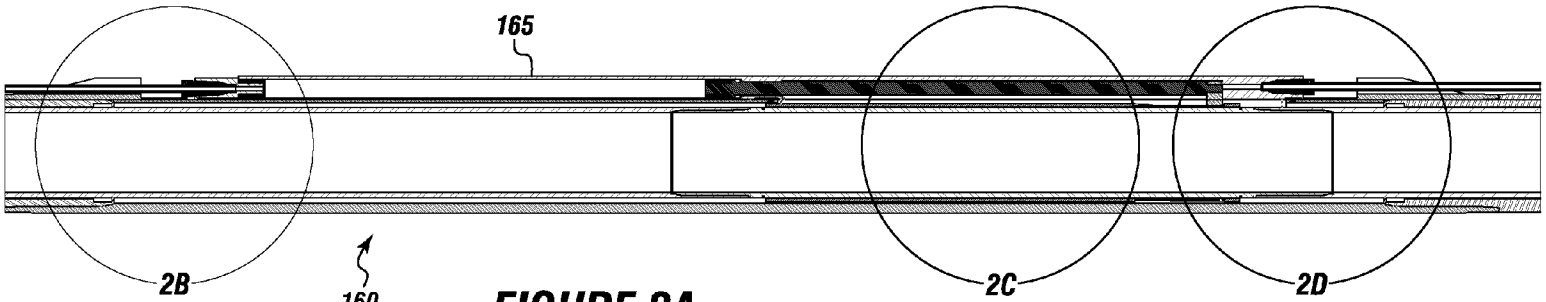
FIG. 2A depicts a cross sectional view of a piston chamber of the downhole tool of the downhole tool assembly according to one or more embodiments.
Figure 2D:
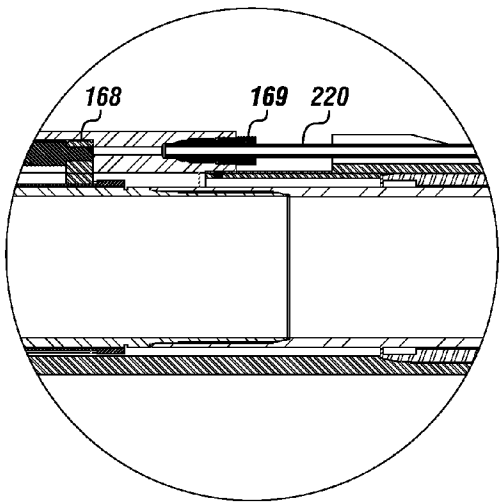
FIG. 2D depicts a detailed view of the piston chamber of the downhole tool of the downhole tool assembly according to one or more embodiments.
Figure 2C:
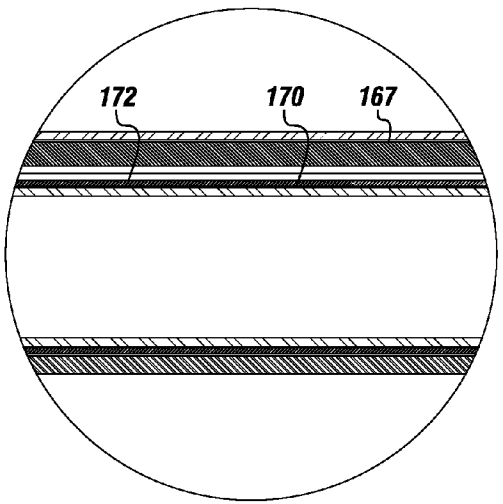
FIG. 2C depicts a detailed view of the piston chamber and logic drum of the downhole tool of the downhole tool assembly according to one or more embodiments.
Figure 2B:
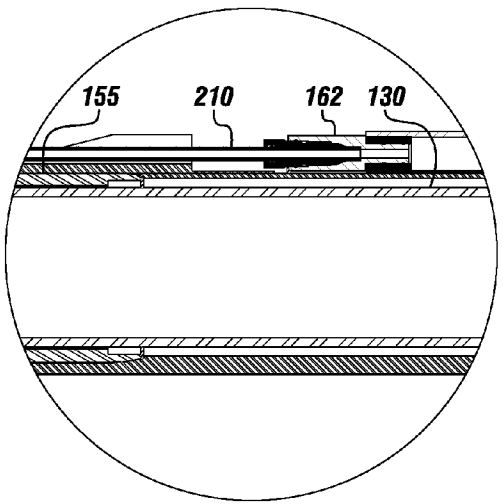
FIG. 2B depicts a detailed view of a portion of the piston chamber of the downhole tool of the downhole tool assembly and a cross over pin for connecting the downhole tool to an upper portion of the downhole tool assembly according to one or more embodiments.

FIG. 2A depicts a cross sectional view of a piston chamber of the downhole tool of the downhole tool assembly according to one or more embodiments. FIG. 2B depicts a detailed view of a portion of the piston chamber of the downhole tool of the downhole tool assembly and a cross over pin for connecting the downhole tool to the upper portion of the downhole tool assembly according to one or more embodiments. FIG. 2C depicts a detailed view of the piston chamber and logic drum of the downhole tool of the downhole tool assembly according to one or more embodiments. FIG. 2D depicts a detailed view of the piston chamber of the downhole tool of the downhole tool assembly according to one or more embodiments.

Referring to FIGS. 2A-2D, a portion of the piston assembly portion 160 can be connected to the cross over pin 155.

The inner tubular member 130 can move within at least a portion of the piston assembly portion 160. The piston assembly portion 160 can include a piston chamber 165, a first port 162 in communication with a portion of the piston chamber 165, a second port 169 in communication with another portion of the piston chamber 165, a piston 167 disposed between the two ports 162 and 169, a force transmitting device 168 connected to a portion of the piston 167, a logic drum carrier 170, and a logic drum 172.

The piston chamber 165 can contain the piston 167. The portion of the piston chamber 165 containing the piston 167 can be configured to allow fluid provided thereto by one or more of the ports 162 and 169 to move the piston 167. For example, the first port 162 can be in fluid communication with a first control line 210, and the second port 169 can be in fluid communication with a second control line 220. As such, the piston 167 can move in a first direction when the first control line 210 is pressured up, and the piston 167 can move in a second direction when the second control line 220 is pressured up.

The piston 167 can be a set of pistons, a sleeve, a single piston, or combinations thereof. For example, the piston chamber 165 can house a member in an upper portion thereof and a second portion thereof. The two members can be collectively referred to as a piston.

The force transmitting device 168 can be operatively connected to the piston 167. The force transmitting device 168 can be configured to move along one or more grooves, not depicted in FIGS. 2A-2D, and to transfer force from the piston 167 to the logic drum 172 when the force transmitting device 168 is at a predetermined location along the logic drum 172.

The logic drum 172 can rotate about the logic drum carrier 170 and can move the logic drum carrier 170 when force is transmitted thereto by the force transmitting device 168.

Figure 3:
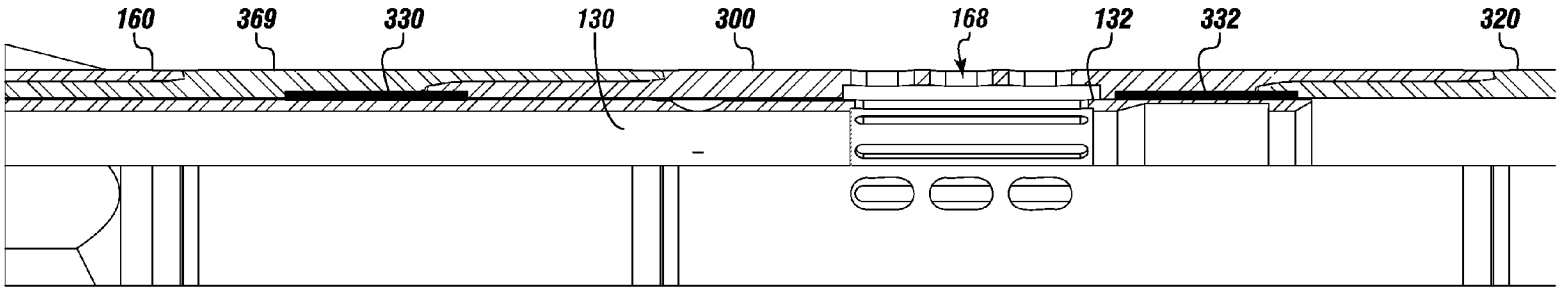
FIG. 3 depicts a cross sectional view of an outer tubular member and inner tubular member of the downhole tool of the downhole tool assembly according to one or more embodiments.

FIG. 3 depicts a cross sectional view of an outer tubular member and an inner tubular member of the downhole tool of the downhole tool assembly according to one or more embodiments.

The piston assembly portion 160 can be operatively engaged with the outer tubular member 300 by a second cross over pin 369. The outer tubular member 300 can include an annulus port 168 formed therethrough.

One or more seals or seal assemblies, such as a first seal assembly 330, can be disposed adjacent to the second cross over pin 369 to provide a seal between the piston assembly portion 160 and the inner tubular member 130.

In addition, one or more seals or seal assemblies, such as a second seal assembly 332, can be provided to isolate the annulus port 168 and a space between the inner tubular member 130 and the outer tubular member 300. The seal assemblies 330 and 332 can be any non-elastomeric material. The seal assemblies can be one or more seals, seal assemblies described herein or one that is commercially available. For example, the seal assemblies can be made from TEFLON™ brand polytetrafluoroethylene, available from DuPont of Wilmington, Del., PEEK™ (polyester ester ketone), also made by Dupont. The seal assemblies can also be made from a blend of a 95 percent PEEK and 5 percent VITON™ brand fluoropolymer elastomer from Dupont.

The inner tubular member 130 can include inner ports 132. The inner ports 132 can be selectively aligned with the annulus ports 168 to provide fluid communication between an annulus formed between the outer tubular member 300 and a wellbore, not depicted in FIG. 3, and an inner bore of the inner tubular member 130.

Also depicted are one or more housing spacers 320.

Figure 4:
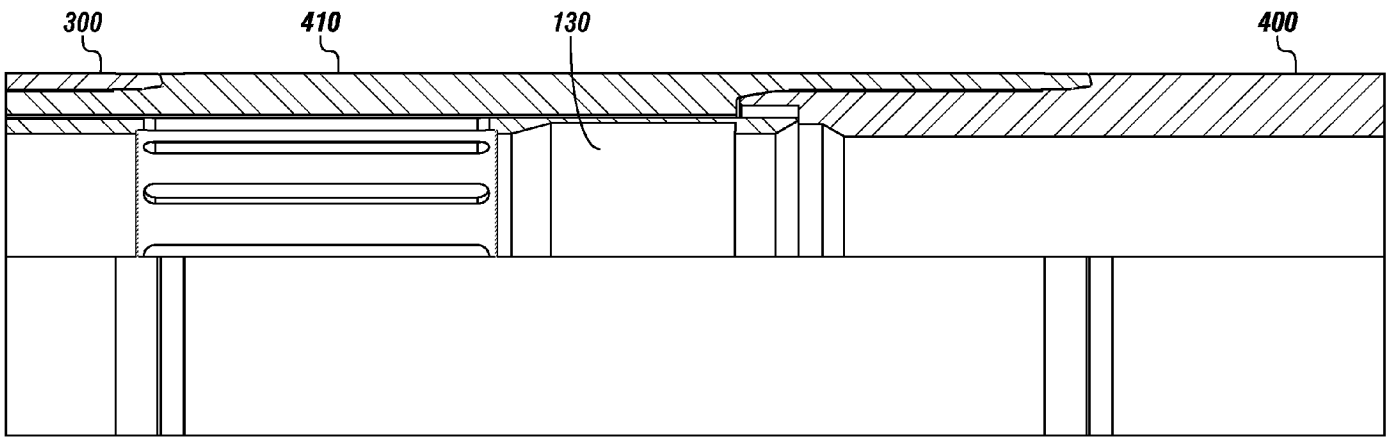
FIG. 4 depicts a cross sectional view of an embodiment of a lower portion of the downhole tool assembly connected to the outer tubular member of the downhole tool according to one or more embodiments.

FIG. 4 depicts a cross sectional view of an embodiment of a lower portion of the downhole tool assembly connected to the outer tubular member of the downhole tool according to one or more embodiments.

The outer tubular member 300 can be configured to operatively engage a bottom sub 400. For example, one or more third cross over pins 410, housing spacers 320 depicted in FIG. 3, or combinations thereof can be used to operatively engage the bottom sub 400 with the outer tubular member 300.

The inner tubular member 130 can be configured to move at least partially within the bottom sub 400. The bottom sub 400 can be configured to connect to one or more adjacent downhole tubulars or tools. For example, the bottom sub 400 can connect to a tubing string or a top sub of an adjacent downhole tool.

Figure 5:
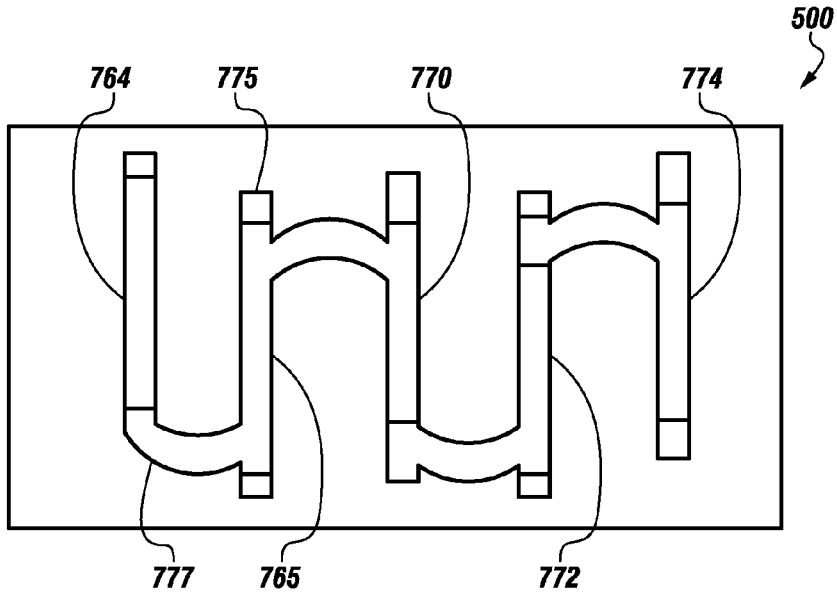
FIG. 5 depicts an unfolded view of a logic drum according to one or more embodiments.
Figure 6:
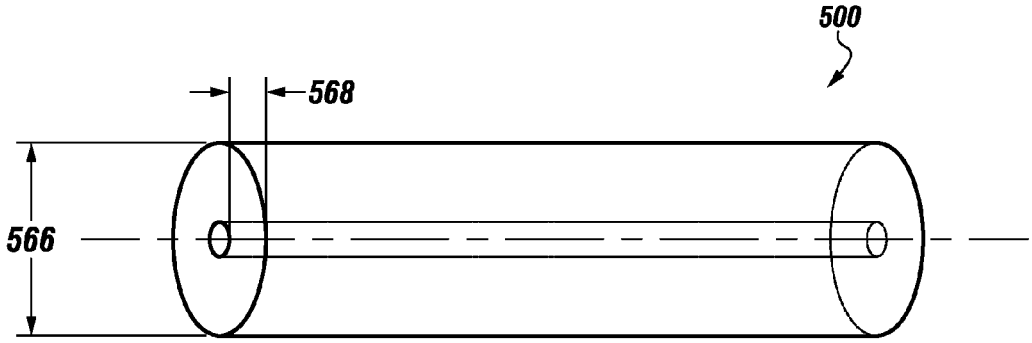
FIG. 6 depicts an isometric view of the logic drum of FIG. 5.

FIG. 5 depicts an unfolded view of a logic drum 500 according to one or more embodiments, and FIG. 6 depicts an isometric view of the logic drum 500 of FIG. 5.

In FIG. 6, the logic drum 500 can have an overall diameter 566 ranging from 2.8 inches to 5.5 inches. The logic drum 500 can have a wall thickness 568 ranging from 0.125 inches to 0.5 inches. The logic drum 500 can have at least two positioning grooves, such as J-slots.

In FIG. 5, a plurality of positioning grooves, such as positioning grooves 764, 765, 770, 772, and 774 can be disposed within the wall of the logic drum 500. The positioning grooves 764, 765, 770, 772, and 774 can range from 25 percent to 75 percent of the length of the logic drum 500. The logic drum 500 can have a length ranging from 8 inches to 60 inches.

The positioning grooves 764, 765, 770, 772, and 774 can have a J-shape. The logic drum 500 can also include one or more landing grooves 775 and a one or more rotation grooves 777. The positioning grooves 764, 765, 770, 772, and 774 can vary in length.

Figure 7:
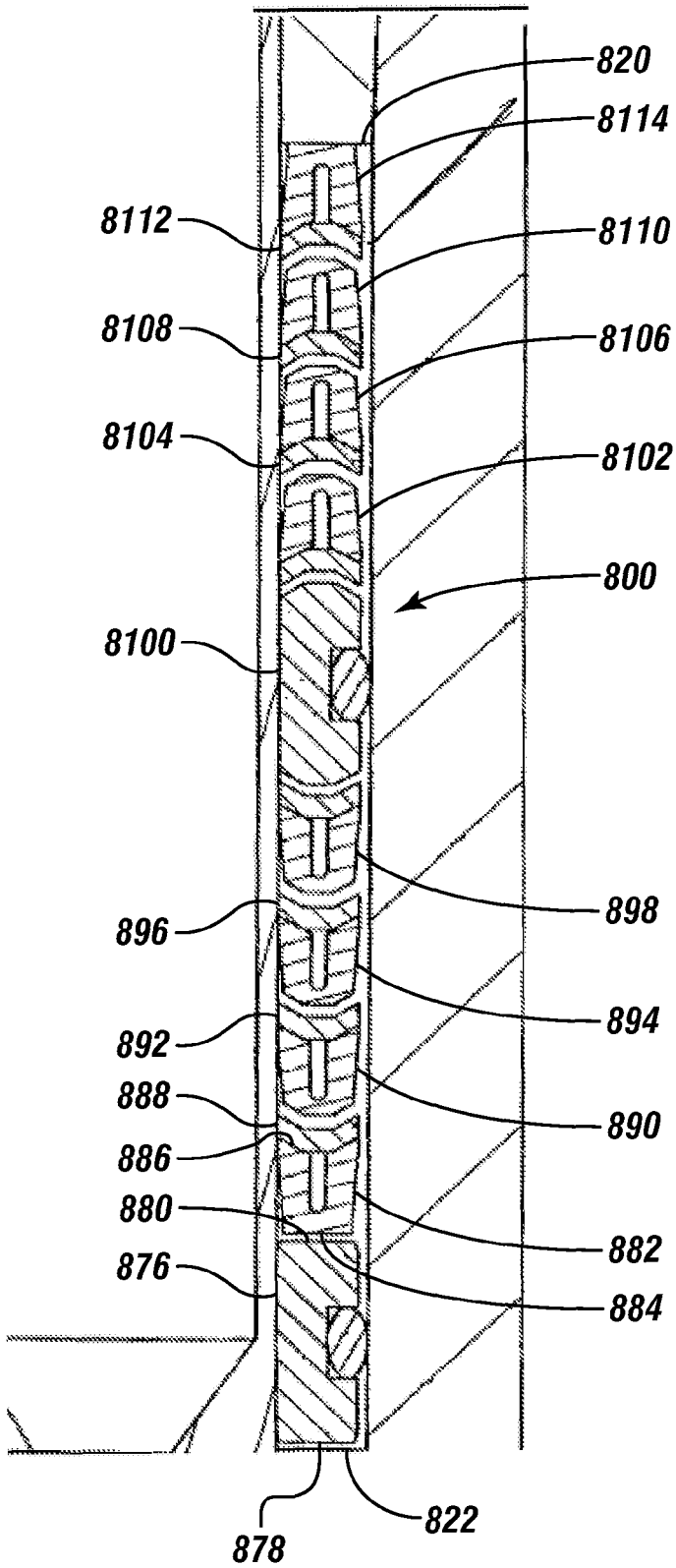
FIG. 7 depicts a seal assembly according to one or more embodiments.

Referring now to FIG. 7, a seal assembly 800 is depicted. The seal assembly 800 can include an equalizing seal means 876. The equalizing seal means 876 can be constructed of filled PEEK™, which is commercially available from Greene, Tweed & Co. under the name ARLON™. The PEEK™ can have a tensile strength greater than 25,000 psi at 70 degrees Fahrenheit, and 13,000 psi at 350 degrees Fahrenheit. All seal means of the seal assembly 800 can be constructed of any equivalent type of material, such as TEFLON™ brand polytetrafluoroethylene, made by the DuPont.

An end 878 of the equalizing seal means 876 abuts the radial shoulder 822, and the opposite end 880 abuts the header seal ring means 882. The header seal ring means 882 can be constructed of filled PEEK™. The header seal ring means 882 can have a first end 884 and a second angled end 886.

A non-extrusion ring 888 can be included, which can be constructed of filled PEEK™. The non-extrusion ring 888 can include a concave shape and can prevent the extrusion and bulging of the ring members on either side.

The seal assembly 800 can further include a first seal ring means 890. The first seal ring means 890 can be constructed of filled PEEK™

A second non-extrusion ring 892 can be provided, which in-turn leads to a second seal ring means 894.

A third non-extrusion ring 896 is also shown which leads to a third seal ring means 898.

The seal assembly 800 can also include a follower seal ring 8100, which can be constructed of filled PEEK™. The follower seal ring 8100 can have a first and second curved surface.

A fourth seal ring means 8102 can be included, wherein one end abuts the follower seal ring 8100 and the other end abuts a fourth non-extrusion ring 8104.

A fifth seal ring means 8106 can be provided that will in-turn abut the fifth non-extrusion ring 8108. The fifth non-extrusion ring 8108 will then abut the sixth seal ring means 8110 that in-turn will abut the sixth non-extrusion ring 8112. The sixth non-extrusion ring 8112 will abut the header seal ring 8114. The header seal ring 8114 will have an angled end abutting the back side of the fifth non-extrusion ring 8108, and a second radially flat end that will abut the radial end 820.

Figure 8A:
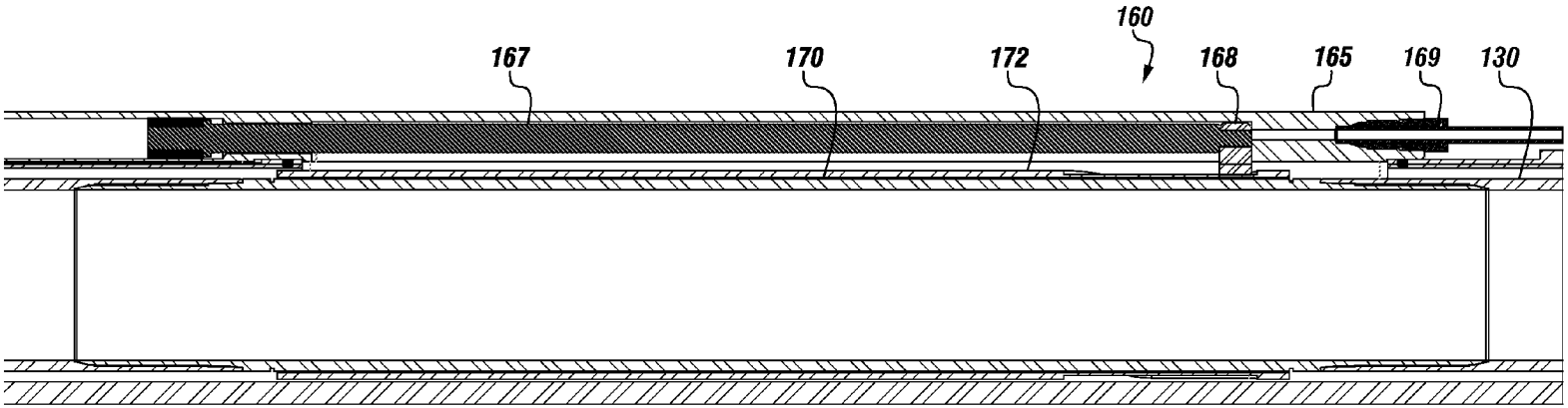
FIG. 8A depicts an embodiment of the piston assembly portion when the piston is in a first position according to one or more embodiments.
Figure 8B:
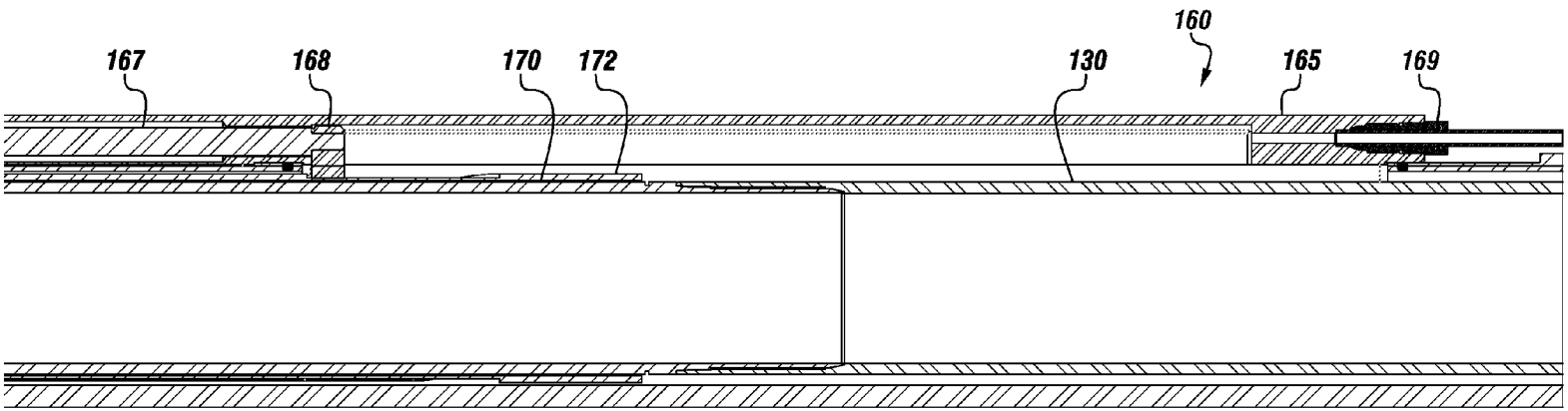
FIG. 8B depicts the piston assembly portion when the piston is in a second position according to one or more embodiments.

FIG. 8A depicts an embodiment of the piston assembly portion 160 when the piston 167 is in a first position, and FIG. 8B depicts the piston assembly portion 160 when the piston 167 is in a second position.

The piston 167 can move within the piston chamber 165 when the first port, not depicted in FIG. 8B or 8B, is provided pressure or fluid from a first control line, not depicted in FIG. 8A or 8B. When the piston 167 is in the first position, the force transmitting device 168 can operatively interact with the logic drum 172, and the logic drum 172 can operatively react with the logic drum carrier 170 to move the inner tubular member 130 to a first position, as shown in FIG. 8A.

The piston 167 can be moved to a second position when the second port 169 is pressured up or provided fluid by a second control line, not depicted in FIG. 8A or 8B.

When the piston 167 is in the second position, the force transmitting device 168 can operatively interact with the logic drum 172, and the logic drum 172 can interact with the logic drum carrier 170 to move the inner tubular member 130 to a second position, as shown in FIG. 8B.

Figure 9A:
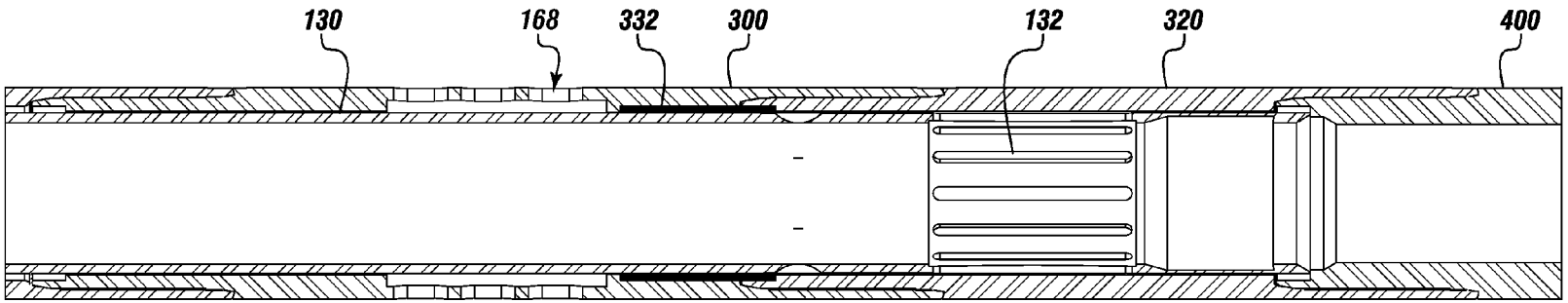
FIG. 9A depicts the inner tubular member in a first position according to one or more embodiments.
Figure 9B:
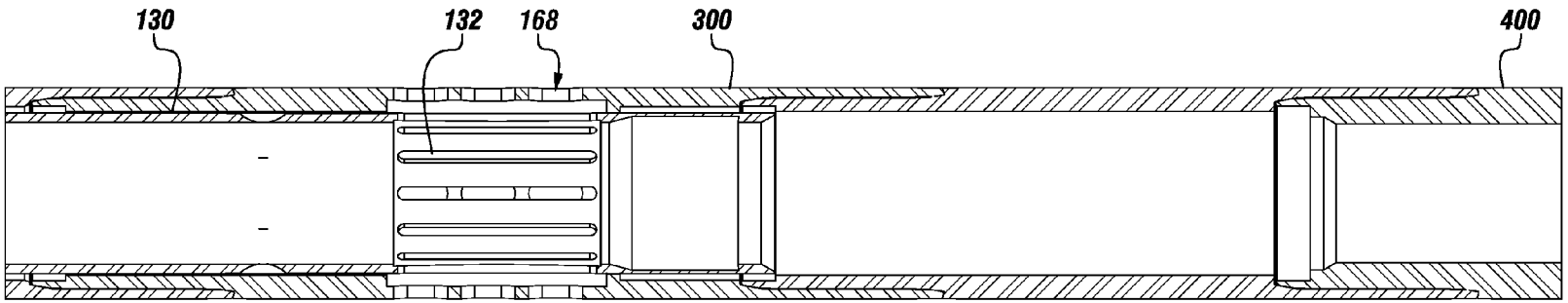
FIG. 9B depicts the inner tubular member in a second position according to one or more embodiments.

FIG. 9A depicts the inner tubular member 130 in a first position, and FIG. 9B depicts the inner tubular member 130 in a second position. Referring to FIGS. 9A and 9B, the outer tubular member 300 is depicted operatively connected to the bottom sub 400.

When the inner tubular member 130 is in the first position, the inner ports 132 are not aligned with the annulus ports 168, as depicted in FIG. 9A. As such, fluid communication between the outer diameter of the outer tubular member 300 and the inner bore of the inner tubular member 130 is at least partially prevented.

The second seal assembly 332 can provide a seal between the inner tubular member 130 and the housing spacers 320.

In FIG. 9B, the inner tubular member 130 is in a second position, and the inner ports 132 are aligned with the annulus ports 168. Accordingly, fluid communication between the outer diameter of the outer tubular member 300 and the inner bore of the inner tubular member 130 is allowed.

Figure 10:
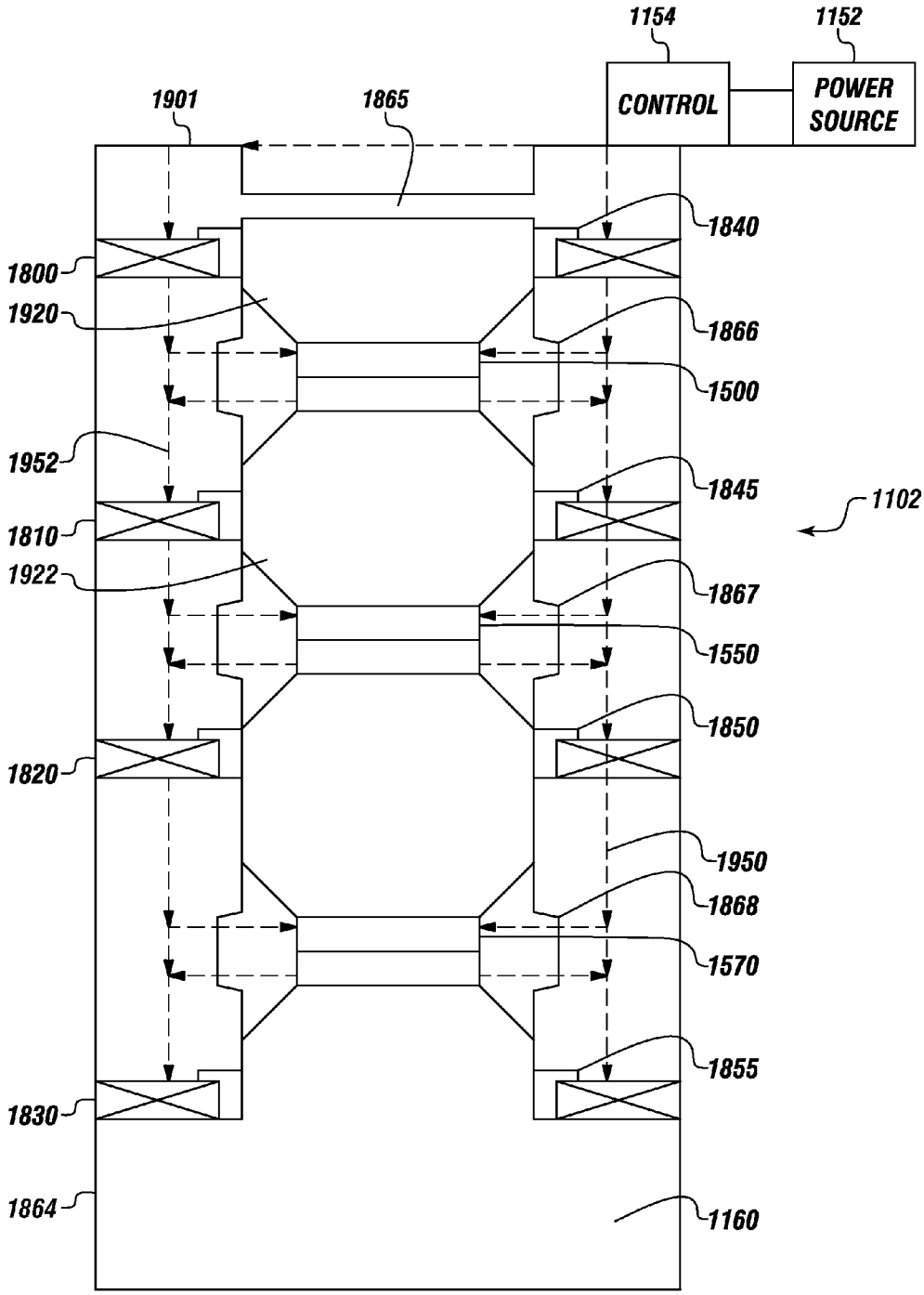
FIG. 10 depicts a system for controlling multiple hydrocarbon bearing zones in a wellbore according to one or more embodiments.

FIG. 10 depicts a system 1102 for controlling multiple hydrocarbon bearing zones in a wellbore according to one or more embodiments. The system 1102 can include a plurality of groups of downhole tools 1500, 1550, and 1570 connected in series or in parallel. The group of downhole tools 1500, 1550, and 1570 can be one or more downhole tools described herein.

The first group of downhole tools 1500 can be disposed between an upper packer 1800 and a middle packer 1810.

The second group of downhole tools 1550 can be disposed below the first group of downhole tools 1500 between the middle packer 1810 and a second middle packer 1820.

The third group of downhole tools 1570 can be disposed between the second middle packer 1820 and a lower packer 1830. The packers 1800, 1810, 1820, 1830 can be any device capable of sealing off an annulus formed between the wellbore 1160 and a inner tubing string 1922.

A first system seal assembly 1840 can be disposed between the upper packer 1800 and the top of the well. A second system seal assembly 1855 can be disposed between the lower packer 1830 and the bottom of the well. A third system seal assembly 1845 and a fourth system seal assembly 1850 can be disposed between each of the middle packers 1810 and 1820.

A control system 1154 can be used to simultaneously operate one or more of the downhole tools simultaneously. The control system 1154 can be an automated control system, such as the one sold by WellDynamics Inc, located in Spring Tex., EP-solutions located in Kingwood, Tex., a mechanical control system, or another commercially available control system.

A safety valve 1865 can be disposed between the first group of downhole tools 1500 and the top of the well. The safety valve 1865 can be any commercially available safety valve.

A tubing hanger 1901 can be disposed between the top of the well and tubing 1920. An inner tubing string 1922 can be connected to the tubing 1920, and located between the upper packer 1800 and the lower packer 1830. The inner tubing string 1922 an be any downhole tubular member or commercially available tubing string.

A first hydrocarbon producing zone can be located between the upper packer 1800 and the middle packer 1810, a second hydrocarbon bearing zone can be located between the middle packer 1810 and the second middle packer 1820. A third hydrocarbon bearing zone can be located between the second middle packer 1820 and the lower packer 1830. The entire system can be stored within a casing 1864.

A first reservoir filter 1866, a second reservoir filter 1867, and a third reservoir filter 1868 can be disposed between the inner tubing string 1922 and the lower packer 1830 and between each hydrocarbon bearing zones. The reservoir filters can be any commercially available reservoir filter.

The control system 1154 can be in communication with a first control line 1950 and a second control line 1952. The control lines 1950 and 1952 can communicate with the groups of downhole tools 1500, 1550, and 1570 through a continuous flow path. For example, the control lines 1950 and 1952 can run through or past the packers 1800, 1810, 1820, and 1830. The control line 1950 and 1952 can branch off into each of the groups of downhole tools 1500, 1550, and 1570.

A power source 1152 can be in communication with the control system 1154.

Figure 11A:
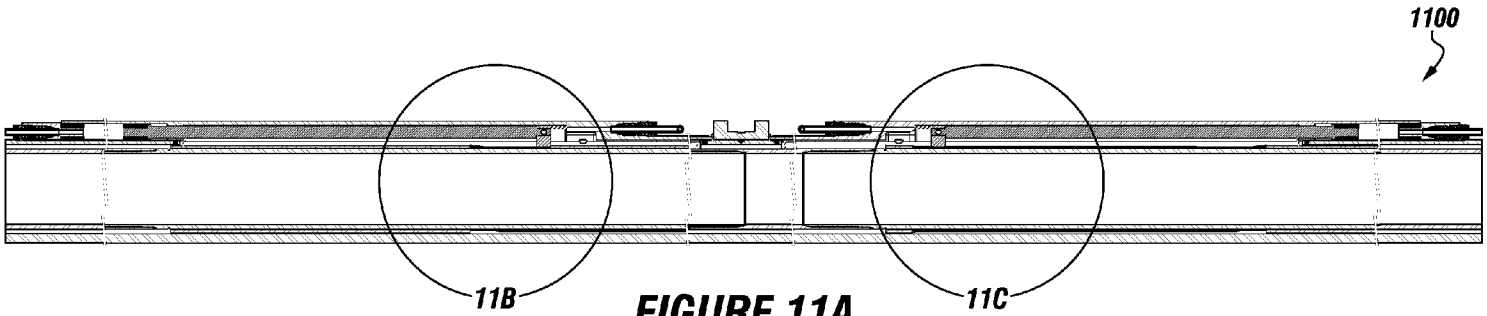
FIG. 11A depicts a piston assembly including two piston chambers and two logic drums operatively aligned therewith according to one or more embodiments.
Figure 11C:
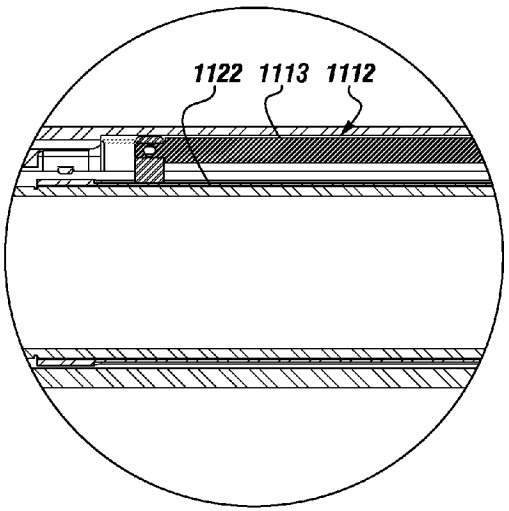
FIG. 11C depicts a detailed view of a portion of a second piston chamber and a second logic drum according to one or more embodiments.
Figure 11B:
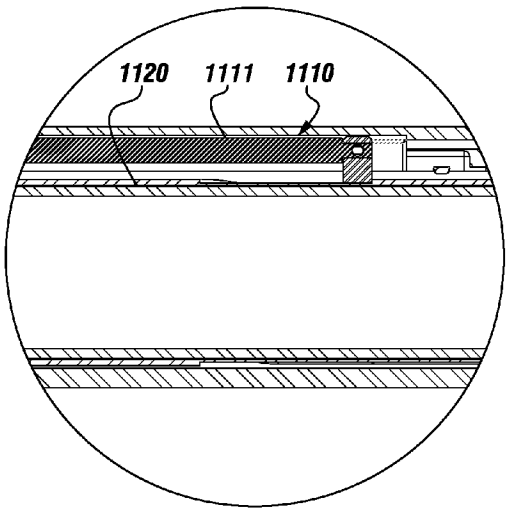
FIG. 11B depicts a detailed view of a portion of a first piston chamber and a first logic drum according to one or more embodiments.

FIG. 11A depicts a piston assembly including two piston chambers and two logic drums operatively aligned therewith according to one or more embodiments. FIG. 11B depicts a detailed view of a portion of a first piston chamber and a first logic drum according to one or more embodiments. FIG. 11C depicts a detailed view of a portion of a second piston chamber and a second logic drum according to one or more embodiments.

Referring to FIGS. 11A-11C, the piston assembly 1100 can include a first piston chamber 1110 and first logic drum 1120. The piston assembly 1100 can also include a second piston chamber 1112 and second logic drum 1122. The logic drums 1120 and 1122 and piston chambers 1110 and 1112 can be similar to those disclosed herein.

Each piston chamber 1110 and 1112 can have one or more pistons, such as piston 1111 and 1113. The pistons 1111 and 1113 can function and be similar to one or more piston disclosed herein.

While these embodiments have been described with emphasis on the embodiments, it should be understood that within the scope of the appended claims, the embodiments might be practiced other than as specifically described herein.

What is claimed is:

1. A system for controlling multiple hydrocarbon bearing zones in a wellbore, the system comprising:

a. a control system configured to provide and cycle control fluid out of a wellbore through a first control line and a second control line;

b. a first downhole tool adjacent a first hydrocarbon bearing zone, wherein the first downhole tool comprises:

i. a first outer tubular member having a first annulus port formed therethrough;

ii. a first inner tubular member comprising a first inner port, wherein the first inner port and the first annulus port are selectively aligned to form a flow path therethrough by moving the first inner tubular member relative to the first outer tubular member;

iii. a first logic drum configured to selectively move the first inner tubular member; and iv. a first piston assembly disposed about the first logic drum, wherein the first piston assembly is configured to move the first logic drum, wherein the first piston assembly comprises a first piston assembly first port in communication with the first control line and a first piston assembly second port in communication with the second control line, wherein the first control line is configured to move a first piston assembly piston of the first piston assembly in a first direction, and wherein the second control line is configured to move the first piston assembly piston in a second direction; and c. a second downhole tool adjacent a second hydrocarbon bearing zone, wherein the second downhole tool comprises:

i. a second outer tubular member having a second annulus port formed therethrough;

ii. a second inner tubular member comprising a second inner port, wherein the second inner port and the second annulus port are selectively aligned to form a flow path therethrough by moving the second inner tubular member relative to the second outer tubular member;

iii. a second logic drum configured to selectively move the second inner tubular member, wherein the second logic drum is out of phase with the first logic drum; and iv. a second piston assembly disposed about the second logic drum, wherein the second piston assembly is configured to move the second logic drum, wherein the second piston assembly comprises a second piston assembly first port in communication with the first control line and a second piston assembly second port in communication with the second control line, wherein the first control line is configured to move a second piston assembly piston of the second piston assembly in a first direction, and wherein the second control line is configured to move the second piston assembly piston in a second direction.

2. A method for controlling at least two hydrocarbon bearing zones that are isolated from one another, wherein the method comprises:

a. communicating a first control line and a second control line in communication with a control system with a first down hole tool adjacent a first hydrocarbon bearing zone, wherein the first downhole tool comprises:

i. a first outer tubular member having a first annulus port formed therethrough;

ii. a first inner tubular member comprising a first inner port, wherein the first inner port and the first annulus port are selectively aligned to form a flow path therethrough by moving the first inner tubular member relative to the first outer tubular member;

iii. a first logic drum configured to selectively move the first inner tubular member; and iv. a first piston assembly disposed about the first logic drum, wherein the first piston assembly is configured to move the first logic drum, wherein the first piston assembly comprises a first piston assembly first port in communication with the first control line and a first piston assembly second port in communication with the second control line, wherein the first control line is configured to move a first piston assembly piston of the first piston assembly in a first direction, and wherein the second control line is configured to move the first piston assembly piston in a second direction;

b. communicating the first control line and second control line with a second downhole tool adjacent a second hydrocarbon bearing zone, wherein the second hydrocarbon bearing zone is isolated from the first hydrocarbon bearing zone, wherein the second downhole tool comprises:

i. a second outer tubular member having a second annulus port formed therethrough;

ii. a second inner tubular member comprising a second inner port, wherein the second inner port and the second annulus port are selectively aligned to form a flow path therethrough by moving the second inner tubular member relative to the second outer tubular member;

iii. a second logic drum configured to selectively move the second inner tubular member, wherein the second logic drum is out of phase with the first logic drum; and iv. a second piston assembly disposed about the second logic drum, wherein the second piston assembly is configured to move the second logic drum, wherein the second piston assembly comprises a second piston assembly first port in communication with the first control line and a second piston assembly second port in communication with the second control line, wherein the first control line is configured to move a second piston assembly piston of the second piston assembly in a first direction, and wherein the second control line is configured to move the second piston assembly piston in a second direction;

c. producing the first hydrocarbon bearing zone by pressuring up the first control line, moving the first piston assembly piston in the first direction and simultaneously moving the second piston assembly piston in the first direction, wherein the first logic drum moves the first inner tubular member to align the first inner port and the first annulus port while the second logic drum does not move the second inner tubular member allowing the second inner port to remain unaligned with the second annulus port, allowing production from the first hydrocarbon bearing zone while the second hydrocarbon bearing zone remains isolated, d. stopping the production of the first hydrocarbon bearing zone by pressuring up the second control line, moving the first piston assembly piston in the second direction and the second piston assembly piston in the second direction, wherein the first piston assembly piston moves the first logic drum causing the first logic drum to move the first inner tubular member misaligning the first inner port with the first annulus port, thereby isolating the first hydrocarbon bearing zone, while the second logic drum does not move the second inner tubular member allowing the second inner port to remain unaligned with the second annulus port; and e. producing the second hydrocarbon bearing zone by pressuring up the first control line; by pressuring up the first control line moving the first piston assembly piston in the first direction and moving the second piston assembly piston in the first direction, wherein the second logic drum moves the second inner tubular member aligning the second inner port with the second annulus port while the first logic drum does not move the first inner tubular member allowing the first inner port to remain unaligned with the second inner port, allowing production of the second hydrocarbon bearing zone while the first hydrocarbon bearing zone.

* * * * *